US008276680B2

(12) United States Patent
Bouthiette et al.

(10) Patent No.: US 8,276,680 B2
(45) Date of Patent: Oct. 2, 2012

(54) METHODS AND APPARATUS FOR PROVIDING EMERGENCY FIRE ESCAPE PATH

(75) Inventors: Zachary J. Bouthiette, Westford, MA (US); David C. Spillman, Shrewsbury, MA (US)

(73) Assignee: Raytheon Company, Waltham, MA (US)

( * ) Notice: Subject to any disclaimer, the term of this patent is extended or adjusted under 35 U.S.C. 154(b) by 598 days.

(21) Appl. No.: 12/543,562

(22) Filed: Aug. 19, 2009

(65) Prior Publication Data

US 2011/0042109 A1 Feb. 24, 2011

(51) Int. Cl.

| | |
|---|---|
| ***A62C 35/00*** | (2006.01) |
| ***A62C 11/00*** | (2006.01) |
| ***A62C 2/00*** | (2006.01) |
| ***A62C 3/00*** | (2006.01) |
| ***A62C 35/58*** | (2006.01) |

(52) U.S. Cl. ..... 169/44; 169/14; 169/30; 169/46; 169/54; 169/71; 169/85; 169/88

(58) Field of Classification Search ..... 169/9, 14, 169/15, 23, 30, 43, 44, 46, 52, 54, 70, 71, 169/72, 76, 85, 88

See application file for complete search history.

(56) References Cited

U.S. PATENT DOCUMENTS

| | | | | |
|---|---|---|---|---|
| 2,832,425 | A | | 4/1958 | Jacobs |
| 2,990,165 | A | | 6/1961 | Joseph |
| 3,199,600 | A | | 8/1965 | Jacobs |
| 3,610,528 | A | | 10/1971 | Felici |
| 3,653,443 | A | | 4/1972 | Dockery |
| 3,802,511 | A | * | 4/1974 | Good, Jr. ..... 169/30 |
| 3,993,138 | A | | 11/1976 | Stevens et al. |
| 4,505,336 | A | | 3/1985 | Thevis et al. |
| 4,773,485 | A | | 9/1988 | Silverman |
| 4,830,116 | A | | 5/1989 | Walden et al. |
| 4,934,602 | A | | 6/1990 | Mattson |
| 4,989,675 | A | | 2/1991 | Papavergos |
| 5,062,487 | A | | 11/1991 | Siria et al. |
| 5,240,183 | A | | 8/1993 | Bedaw et al. |
| 5,249,746 | A | | 10/1993 | Kaneko et al. |
| 5,330,105 | A | | 7/1994 | Kaylor |

(Continued)

FOREIGN PATENT DOCUMENTS

CA 2 346 995 A1 10/2002

(Continued)

OTHER PUBLICATIONS

Notification of Transmittal of the International Search Report and the Written Opinion of the International Searching Authority, or the Declaration, PCT/US2010/044949, date of mailing Nov. 18, 2010, 7 pages.

(Continued)

*Primary Examiner* — Len Tran
*Assistant Examiner* — Ryan Reis
(74) *Attorney, Agent, or Firm* — Daly, Crowley, Mofford & Durkee, LLP

(57) ABSTRACT

Methods and apparatus for fire egress/escape comprising a first container for storing a first fluid, a second container for storing a propellant, a nozzle to mix and atomize material from the first and second containers for forming a mist to suppress flame by evaporation, and an activation mechanism to enable a user to release material in the first and second containers for generating the mist.

20 Claims, 9 Drawing Sheets

U.S. PATENT DOCUMENTS

| | | | | |
|---|---|---|---|---|
| 5,520,331 | A | 5/1996 | Wolfe | |
| 5,597,044 | A | 1/1997 | Roberts et al. | |
| 5,603,453 | A | 2/1997 | Weaver et al. | |
| 5,623,995 | A * | 4/1997 | Smagac | 169/30 |
| 5,669,449 | A | 9/1997 | Polan et al. | |
| 5,685,376 | A | 11/1997 | Tirronen et al. | |
| 5,799,735 | A | 9/1998 | Sundholm | |
| 5,931,233 | A | 8/1999 | La Bonte et al. | |
| 6,065,546 | A | 5/2000 | Uetake et al. | |
| 6,104,301 | A * | 8/2000 | Golden | 340/628 |
| 6,142,382 | A | 11/2000 | Ting et al. | |
| 6,173,791 | B1 | 1/2001 | Yen | |
| 6,189,625 | B1 | 2/2001 | Hopkins | |
| 6,223,827 | B1 | 5/2001 | Zuev et al. | |
| 6,241,164 | B1 | 6/2001 | Wolfe | |
| 6,311,780 | B1 * | 11/2001 | Zuev et al. | 169/46 |
| 6,360,968 | B1 | 3/2002 | Orrange et al. | |
| 6,422,319 | B2 | 7/2002 | Haase, III | |
| 6,422,320 | B1 | 7/2002 | Mather et al. | |
| 6,478,240 | B1 | 11/2002 | Dorkin et al. | |
| 6,510,901 | B2 | 1/2003 | Yen et al. | |
| 6,543,547 | B2 | 4/2003 | Neumeir et al. | |
| 6,598,802 | B2 | 7/2003 | Wolfe | |
| 6,708,903 | B2 | 3/2004 | Kanno | |
| 6,915,965 | B2 * | 7/2005 | Siebert | 239/270 |
| 6,935,576 | B2 | 8/2005 | Hara | |
| 7,185,829 | B2 | 3/2007 | Sundholm | |
| 7,458,427 | B2 | 12/2008 | Braun et al. | |
| 7,523,876 | B2 | 4/2009 | Wolfe | |
| 2007/0278327 | A1 | 12/2007 | Wolfe | |
| 2008/0245886 | A1 | 10/2008 | Wolfe | |
| 2009/0260839 | A1 * | 10/2009 | Itano et al. | 169/85 |

FOREIGN PATENT DOCUMENTS

| | | | |
|---|---|---|---|
| EP | 1 588 741 | A1 | 10/2005 |
| EP | 1 938 868 | A1 | 7/2008 |
| JP | 2000-140143 | | 5/2000 |

OTHER PUBLICATIONS

Written Opinion of the International Searching Authority, PCT/US2010/044949, date of mailing Nov. 18, 2010, 7 pages.

U.S. Appl. No. 11/875,495, filed Apr. 23, 2009, Gutlapalli.

U.S. Appl. No. 10/919,892, filed Aug. 17, 2004, Erwin.

John W. Reinhardt, "Minimum Performance Standard for Aircraft Cargo Compartment Halon Replacement Fire Suppression Systems (2nd Update)", Jun. 2005, U.S. Department of Transportation, Federal Aviation Administration, National Technical Information Service, Springfield, Virginia, pp. 1-30.

Securiplex LLC, "Industrial Nozzels", Sep. 2004, DS-12105-00, Rev. (F) Fire-Scope® 2000 Components, 2 pages.

"The U.S. Fire Department Profile Through 2007", by Michael J. Karter, Jr., NFPA, Quincy, MA, Nov. 2008, 1 page.

Chad E. Moore, "Design, Development, and Analysis of a Twin-Fluid Fire Suppression Atomizer and Characterization of Electrostatically Charged Droplet Sprays", Dec. 2003, B.S. University of Southern Mississippi, 1997, pp. 1-253.

Notification Concerning Transmittal of International Preliminary Report on Patentability (Chapter 1 of the Patent Cooperation Treaty), PCT/US2010/044949, date of mailing Mar. 1, 2012, 2 pages.

Written Opinion of the International Searching Authority, PCT/US2010/044949, date of mailing Mar. 1, 2012, 6 pages.

* cited by examiner

METHODS AND APPARATUS FOR PROVIDING EMERGENCY FIRE ESCAPE PATH

BACKGROUND

As is well known in the art, fighting fires is dangerous activity. An average of 104 firefighters per year have been killed in the line of duty from 2000-2007. Many of the deaths occur because firefighters get lost or trapped in buildings. They may become surrounded by fire and/or cannot return the way they entered. In many cases, firefighters run out of air in a portable breathing apparatus and perish in the fire. Deaths also occur from stroke and heart attacks due to smoke inhalation.

Firefighters are generally equipped with self-contained breathing apparatus (SCBA), axes and emergency escape devices. Using these tools, firefighters can cut through walls, for example, in order to find a way out and avoid smoke and flames. If they can get to an outside wall or window in time, they deploy the emergency escape device and rappel down or wait for rescue.

SUMMARY

The present invention provides methods and apparatus for escaping a fire by spraying a mist to temporarily subdue or diminish flame in an area and thereby create a pathway to exit the area or structure. While exemplary embodiments are shown and described as having particular configurations, materials, and components to effect fire suppression for a firefighter, it is understood that the invention has application in general where it is desirable to combat fire.

In one aspect of the invention, a system comprises a first container for storing a first fluid, a second container for storing and providing a propellant, a nozzle to mix and atomize material from the first and second containers for forming a mist to suppress a flame, a propellant regulator coupled to the second container, and an activation mechanism to enable a user to release material in the first and second containers for generating the mist.

The system can further include one or more of the following features: the nozzle is attachable to a harness, the first fluid is water, the first fluid is provided at a nozzle pressure ranging from about 10 PSI to about 50 PSI, the nozzle provides the mist having particles approximately 25-500 microns in size, the second container is a tank for a self contained breathing apparatus (SCBA), the second container is integrated with the SCBA tank, the activation mechanism includes a pull cord, the nozzle includes dual inputs to mix materials from the first and second containers through a converge/diverge Venturi, a further nozzle for directing the mist in a direction different from the nozzle.

In another aspect of the invention, a system comprises a harness, an air tank for supplying air to a user, a firefighter breathing apparatus coupled to the air tank to provide air to a user, a first container for storing a first fluid, the first container secured to the air tank, a second container for storing and providing a propellant, a nozzle to atomize material from the first container for forming a mist to suppress a flame, a first regulator coupled to the first container to regulate the exit of the first fluid from the first container, a second regulator coupled to the second container, and an activation mechanism to enable a user to release material in the first and second containers for generating the mist.

In a further aspect of the invention a method comprises providing a first container to hold a first fluid, providing a second container to hold a propellant, providing a nozzle to mix and atomize material from the first and second containers for forming a mist to suppress a flame, coupling a first regulator coupled to the first container to regulate the exit of the first fluid from the first container, coupling a second regulator to the second container, providing tubing for fluid connection from the first and second containers to the nozzle, and providing an activation mechanism to enable a user to release material in the first and second containers for generating the mist.

BRIEF DESCRIPTION OF THE DRAWINGS

The foregoing features of this invention, as well as the invention itself, may be more fully understood from the following description of the drawings in which.

DETAILED DESCRIPTION

In general, exemplary embodiments of the invention provide fire suppression to create a pathway for emergency escape from an environment overcome with fire. A firefighter, for example, surrounded by flames can activate the inventive fire suppression device to create a temporary escape path to exit a building or other structure.

Figure 1:
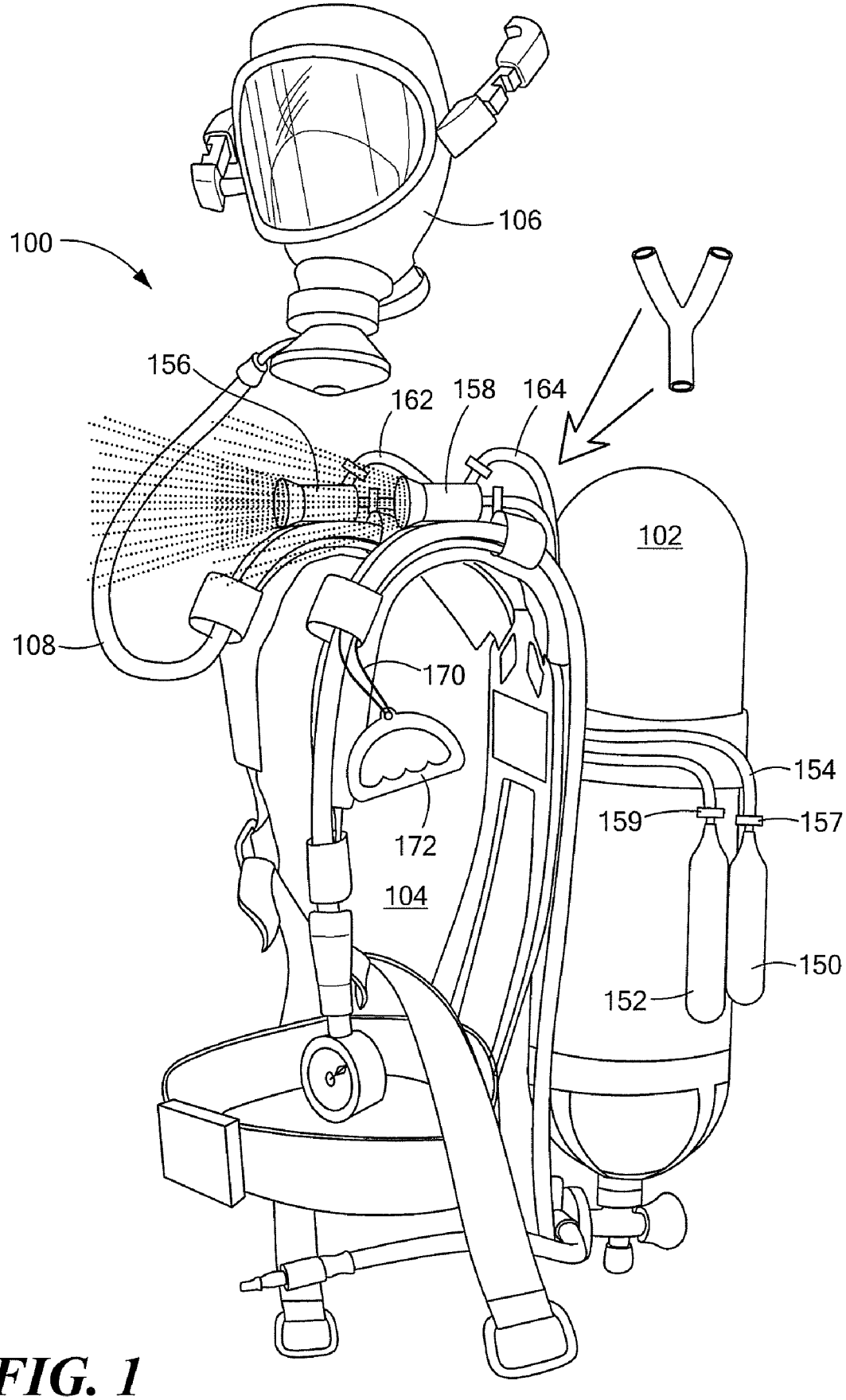
FIG. 1 is a schematic representation of a fire escape/egress system in accordance with exemplary embodiments of the invention.
Figure 2:
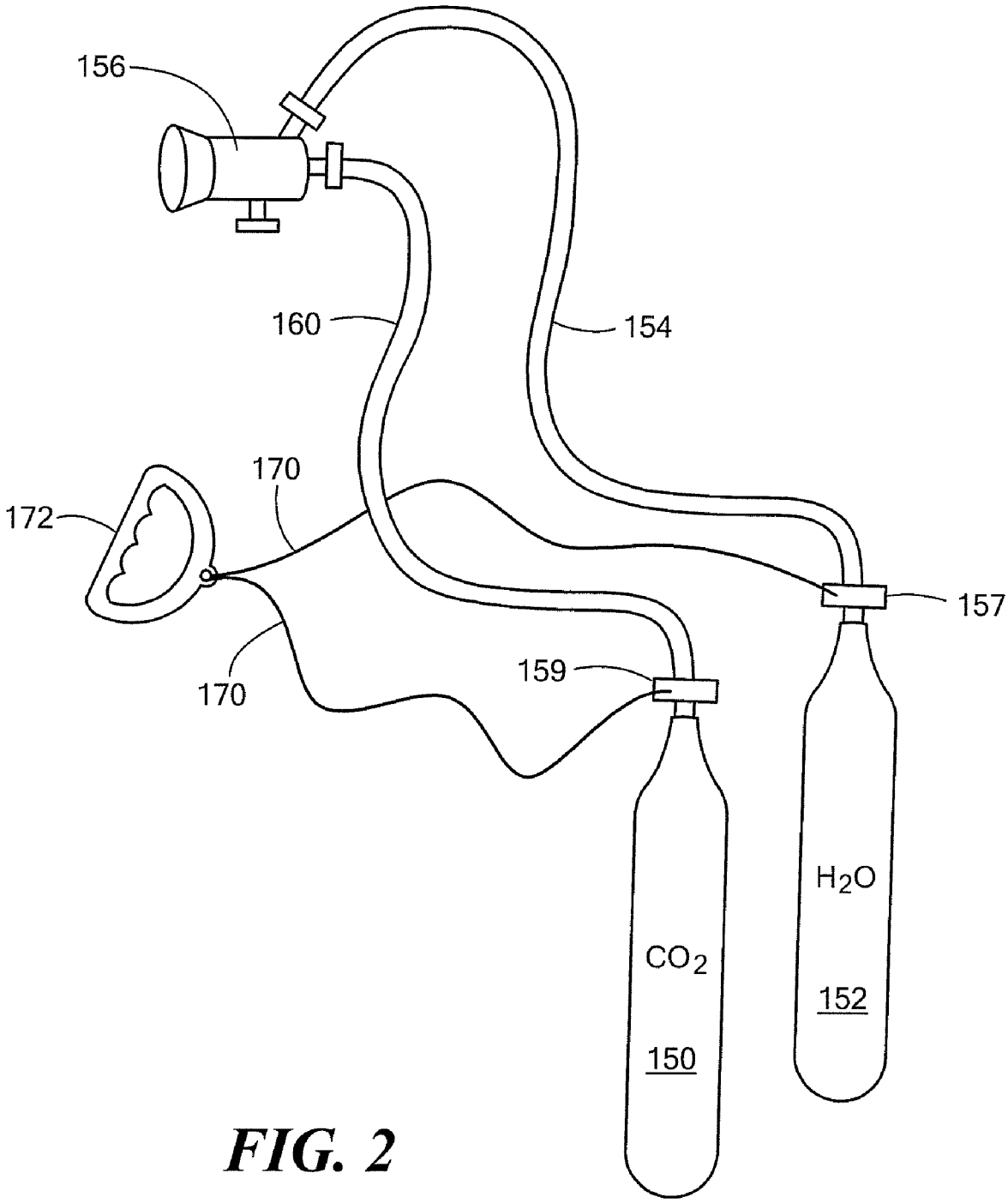
FIG. 2 is a schematic representation of a fire escape/egress system in accordance with exemplary embodiments of the invention.

FIGS. 1 and 2 show an exemplary fire escape/egress system 100 in accordance with exemplary embodiments of the invention. In the illustrated embodiment, a fire suppression subsystem is integrated into a firefighter breathing apparatus. A compressed air tank/container 102 is supported by a harness 104 configured to be worn over the shoulders. Headgear 106 includes a transparent face shield and a hose 108 coupled to the air tank 102 to provide air to the user.

In an exemplary embodiment, a first tank 150 and a second tank 152 are secured on or about the air tank 102. In one embodiment, the first tank 150 is configured to contain water and the second tank 152 is configured to contain CO2. In another embodiment, the first tank contains water or other liquid suppressor and CO2 and the second tank contains CO2 or another non-flammable propellant.

A first tube 154 is coupled to the first tank and terminates in a Y-coupling having a first port 162 coupled to a first nozzle 156 and a second port 164 coupled to a second nozzle 158. Similarly, a second tube 160 is coupled at one end to the second tank 152 and at the other end a first port is coupled to the first nozzle 156 and a second port is coupled to the second nozzle 158. A first release valve 157 can be coupled between the first tank 150 and the first tube 154 and a second release valve 159 can be coupled between the second tank 152 and the second tube 160. In other embodiments, coaxial tubes are used.

Figure 2A:
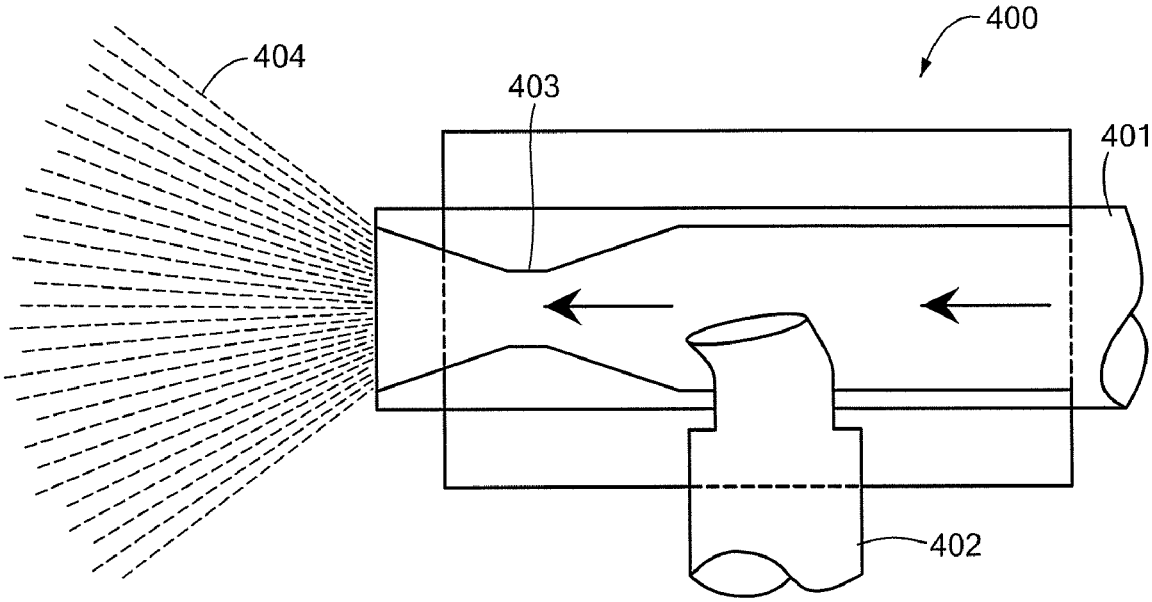
FIG. 2A is a schematic representation of an exemplary nozzle that can form a part of a fire escape/egress system in accordance with exemplary embodiments of the invention.

The nozzles 156, 158 should atomize the water and CO2, or other combined materials, so as to generate a mist having optimal fire suppression characteristics. In general, the mist should contain particles less than about 50-100 microns in size. As shown in FIG. 2A, an exemplary atomizing nozzle 400 include dual inputs 401, 402 that mix low pressure liquid and gas through a converge/diverge Venturi 403 in order to provide a high momentum finely atomized mist 404.

In general, water and propellant are delivered in parallel and mixed in the converge/diverge Venturi 403. The water then flows into a section with the air now highly compressed by the convergent walls of the nozzle. In the divergent area of the nozzle, the air rapidly expands and accelerates resulting in the creation of small water particles forming the water mist. The mist is created by the water and propellant stored at relatively low pressures, allowing for variable coverage patterns and area.

It is understood that a wide variety of nozzles can be used to meet the needs of a particular application. One exemplary nozzle is shown and described in U.S. Pat. No. 5,520,331, which is incorporated herein by reference. In this embodiment, the first fluid is provided at a nozzle pressure of about 20-25 psi and the propellant is provided at a pressure of about 18-25 psi. Another exemplary nozzle is commercially available from Securiplex, LLC, 3710 Lakeside Court, Mobile, Ala. 36693. The Securiplex 5JET60 (P/N RNZ-15394-10) or 5JET90 (P/N RNZ-15395-10) could be utilized at first fluid pressures from about 40-45 PSI and propellant pressures from about 60-65 PSI. A further exemplary nozzle is commercially available from Spraying Systems Company, P.O. Box 7900, Wheaton, Ill. 60189. The Spraying Systems SU-42 nozzle can be utilized at first fluid pressures from about 10-20 PSI and propellant pressures ranging from about 14-28 PSI.

The fire escape/egress system 100 includes an activation mechanism to enable a user to activate the fire suppression functionality. In the illustrated embodiment, the activation mechanism includes a handle 172 (FIG. 2) and pull cord 170 within easy reach of a firefighter. The user/firefighter pulls the cord 170 to release the pressurized water and CO2 from the respective first and second tanks 150, 152 by actuation of the respective release valves 157, 159. In one embodiment, the pull cord releases the entire contents of the first and second tanks. In other embodiments, the user must maintain pressure on the pull cord in order continue mist generation.

It is understood that the activation mechanism can include any practical implementation including push buttons, electromechanical configurations, dials, heat sensors, and the like. Activation can generate a one-time complete release of the mist. Alternatively, activation of the fire suppression mist can run for a predetermined about of time, say ten seconds, after which the activation mechanism must be re-triggered. Alternatively, activation of the system can be done remotely by a comrade or leader.

While shown as having first and second nozzles, it is understood that a single nozzle, as shown in FIG. 2, can be used or more than two nozzles can be used. That is, any practical number of nozzles can be used. In addition, the location of the nozzles can be provided in various locations instead of, or in addition to, a shoulder-based nozzle. For example, a nozzle can be located on the head gear 106 (FIG. 1). Further, the direction of the nozzles can be pointed in any suitable direction. For example, for a system having four nozzles, a first nozzle can be directed forward from the harness, a second nozzle can be directed backward, and third and forth nozzles can be directed to opposite sides.

It is understood that the first and second tanks 150, 152 can be secured to various components of the system 100 in various ways to meet the needs of a particular application without departing from the scope of the present invention. In one embodiment, the first and second tanks 150, 152 are coupled to the main air tank of a SCBA system. In another embodiment, the first and second tanks can be provided with a barrier or membrane dividing a container.

Figure 3:
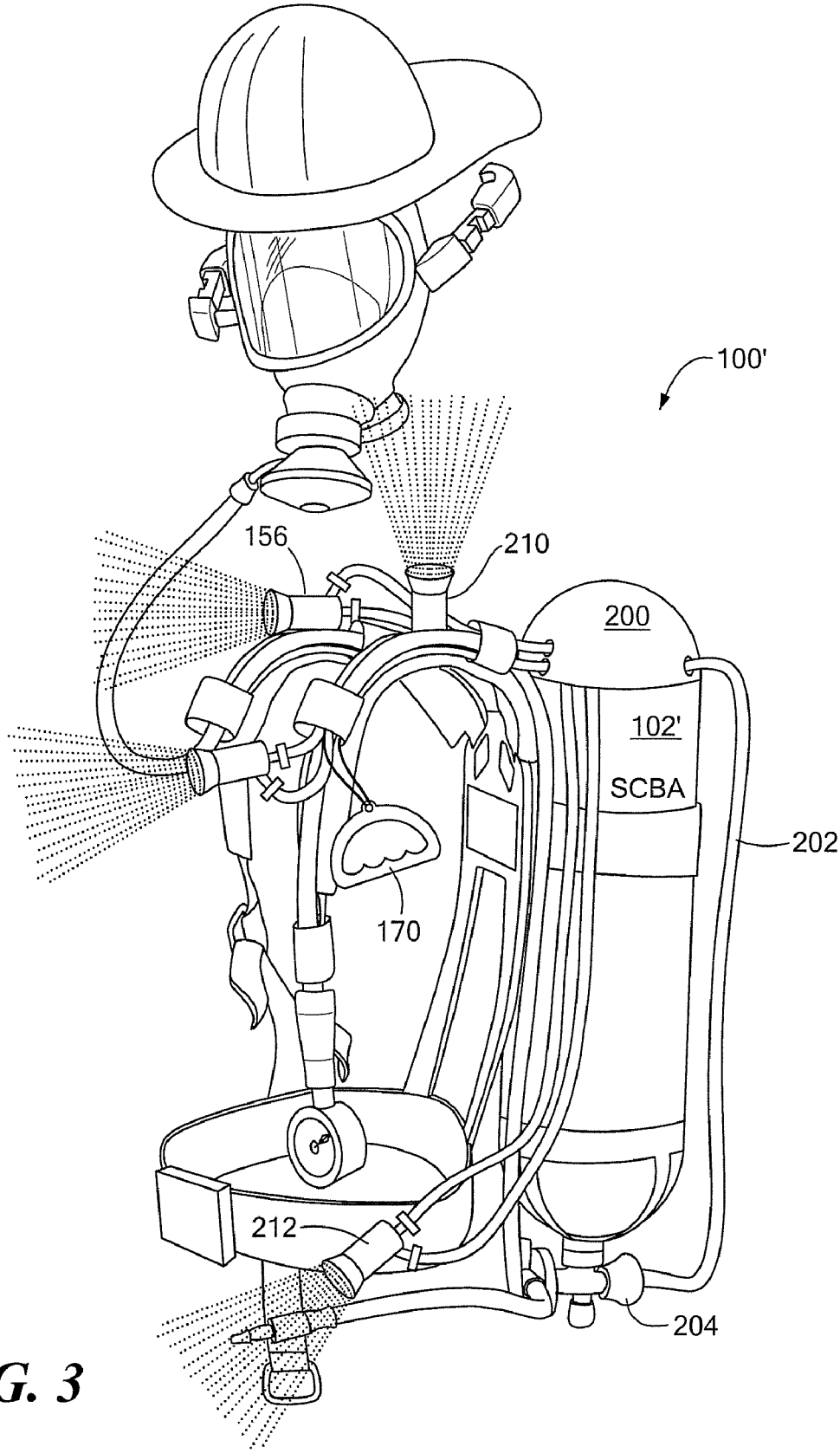
FIG. 3 is a schematic representation of a further fire escape/egress system in accordance with exemplary embodiments of the invention.

FIG. 3 shows an exemplary fire escape/egress system 100' integrated with a SCBA system. The system 100' of FIG. 3 has some features common to the system 100 of FIG. 1, wherein like reference numbers indicate like elements. A first tank 200 for storing liquid, such as water, is integrated with a SCBA air tank 102' for supplying air to a user. A tube 202 from a pressure regulator 204 on the SCBA tank 102' to the first tank pressurizes the contents of the first tank when the system is activated.

The system 100' also shows a nozzle 210 to generate an upward fire suppression mist and a nozzle 212 to generate a downward mist. In one embodiment, the nozzle 212 can be manipulated by a user in the harness to direct the mist in a desired direction.

Figure 3A:
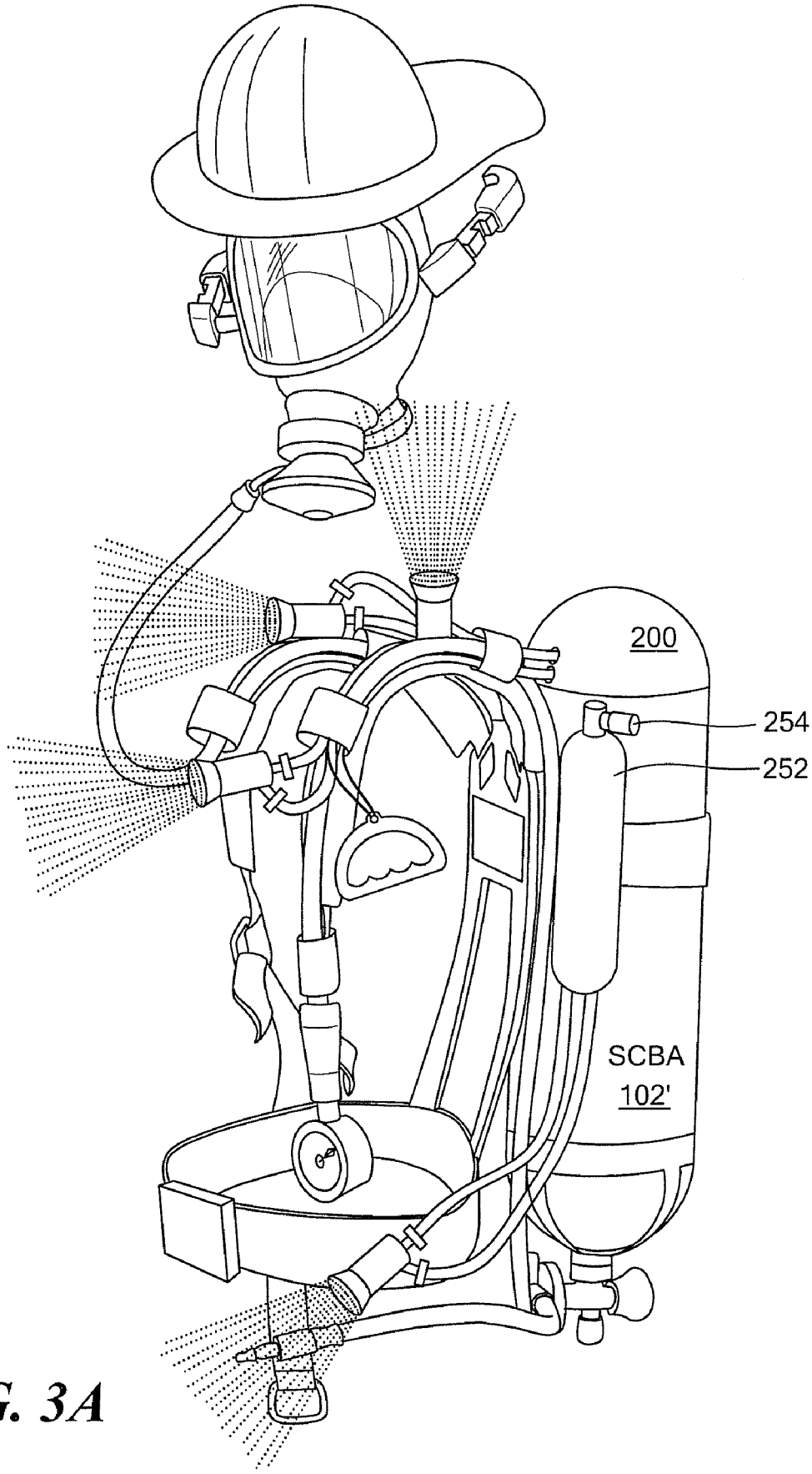
FIG. 3A is a schematic representation of a further fire escape/egress system in accordance with exemplary embodiments of the invention.

FIG. 3A shows a further embodiment of a fire escape/egress system 100" integrated with a SCBA system in which the fluid storing tank(s) 200 is integrated with a SCBA air tank 102" and pressurized by a tank 252 secured to the SCBA air tank. The pressurizing tank 252 is coupled to the fluid tank 200 via a tube/regulator 254.

Figure 4:
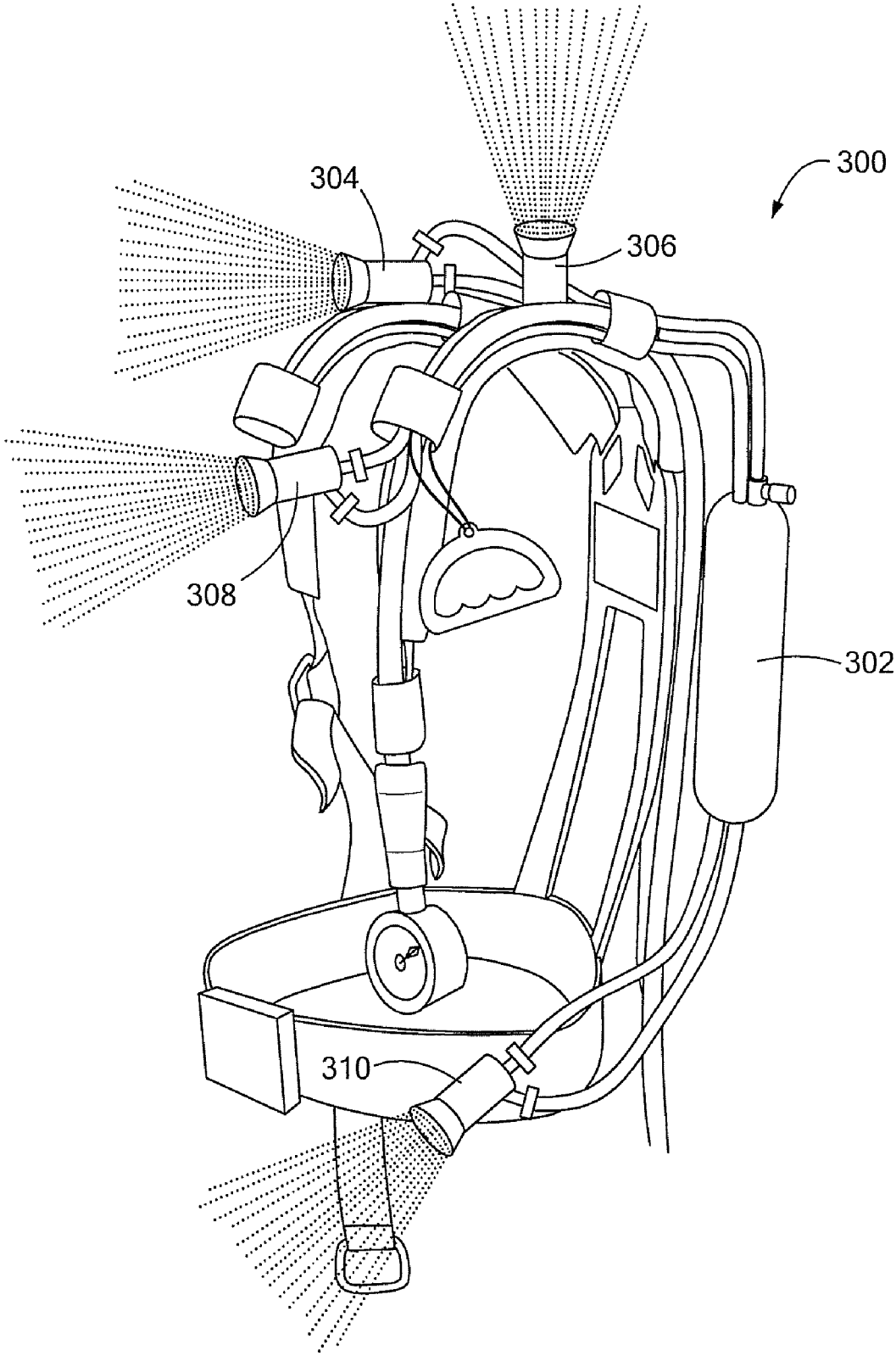
FIG. 4 is a schematic representation of a further fire escape/egress system in accordance with exemplary embodiments of the invention.

FIG. 4 shows a stand alone fire escape/egress system 300 with tank(s) 302 to generate a fire suppression mist via nozzles 304, 306, 308, 310. As can be seen, the respective nozzles can generate a mist to the front, top, and bottom of a user. In one embodiment, the user can select one or more of the nozzles for a desired mist application.

In an exemplary embodiment, water under low pressure is combined with a propellant such as CO2, and directed through an atomizing nozzle(s) to disperse a water-based mist/fog. The pressure can range from about 10-40 PSI of liquid to about 10-50 PSI gas, with more optimal ranges from 15-30 PSI of liquid and 30-40 PSI of gas dependent on the application. It should be noted that these relatively low pressure levels provide an unexpected fire suppression result. That is, relatively small amounts of water/gas mist generated at relatively low pressures provide an unexpected fire suppression effect. This effect is due from the different way in which the mist affects flame including steam expansion, displacement of oxygen, cooling of surfaces and/or absorption. In traditional fire fighting apparatus, high pressure is used to spray large volumes of water for suppressing fire primarily by oxygen deprivation, steam expansion and saturation of material to prevent further burning. In contrast, exemplary embodiments of the invention spray a fine mist that evaporates in a controlled manner so as to take heat from the flame and thereby suppress it, allowing for a lightweight portable system.

In exemplary embodiments, the generated mist provides fire suppression for a duration of about one minute. It is understood that more and less water/gas can be provided to create longer and shorter mist durations to meet the needs of a particular application.

In one embodiment, the nozzles are attached to the user harness by hook and loop fastener, quick connect buttons, and other suitable mechanisms known to one of ordinary skill in the art. With this arrangement, the nozzles can be configured for user preferences and fire-fighting applications and can be located where the nozzles are most comfortable on the harness. This also allows for the placement of nozzle(s) in different locations on the harness, e.g. on the shoulder, near the waist, back or chest.

In another embodiment, the nozzles are secured, e.g., sewn, directly into the harness material and permanently attached to the harness. For example, the nozzles may be sewn onto the shoulder, chest or waist portions of the harness pointing in front, behind, or above the user.

Figure 3B:
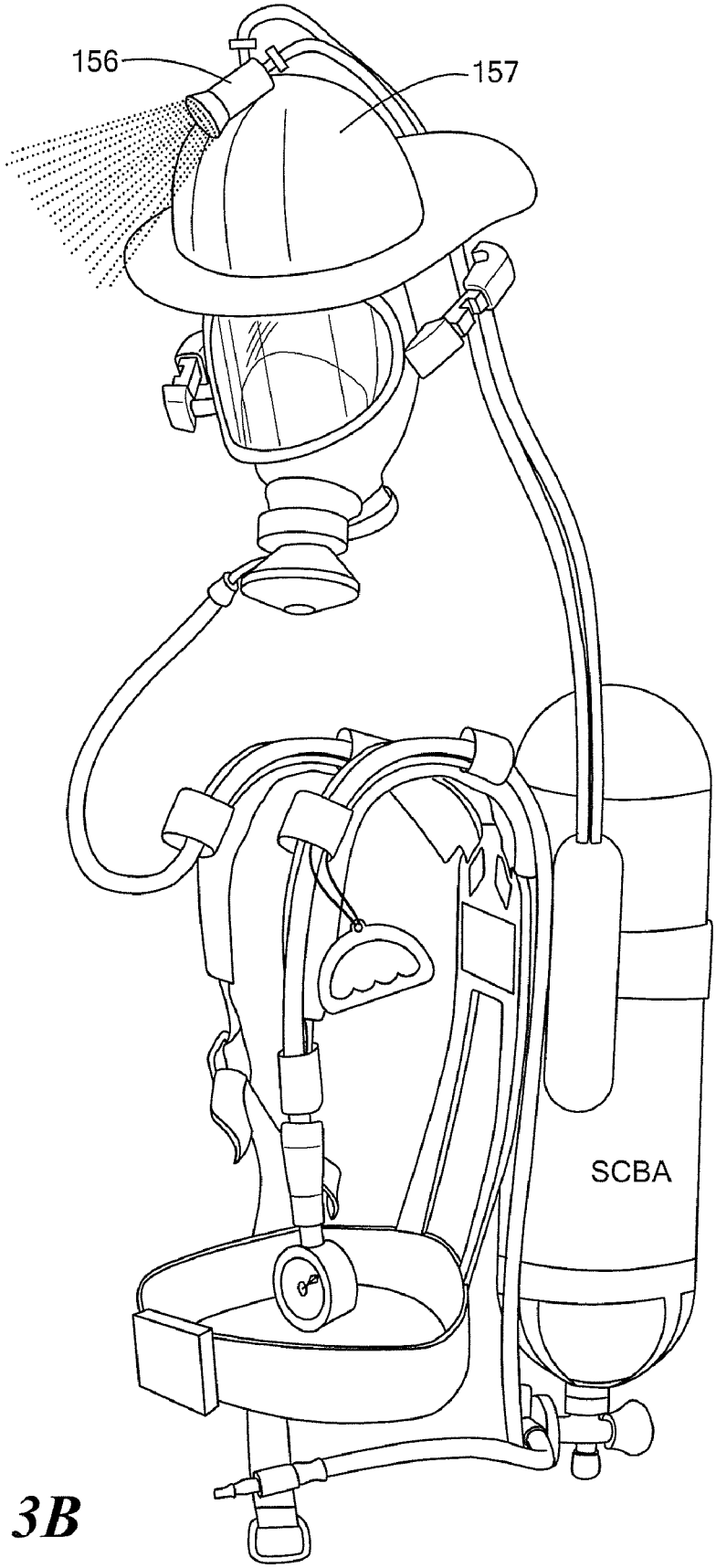
FIG. 3B is a schematic representation of another fire escape/egress system in accordance with exemplary embodiments of the invention.

In another embodiment, the nozzle orientation may have a variety of configurations. One nozzle may be shoulder mounted pointing upwards, one may be shoulder mounted pointing in front of the user, and one may be pointing behind the user, as in FIG. 3. In other embodiments, first and second nozzles 156, 158 are shoulder mounted pointing in front of the user, as shown in FIG. 1. In a further embodiment shown in FIG. 3B, a nozzle 156 is mounted on a helmet 157 and is configured to allow a user to point the nozzle in specific direction.

Figure 3C:
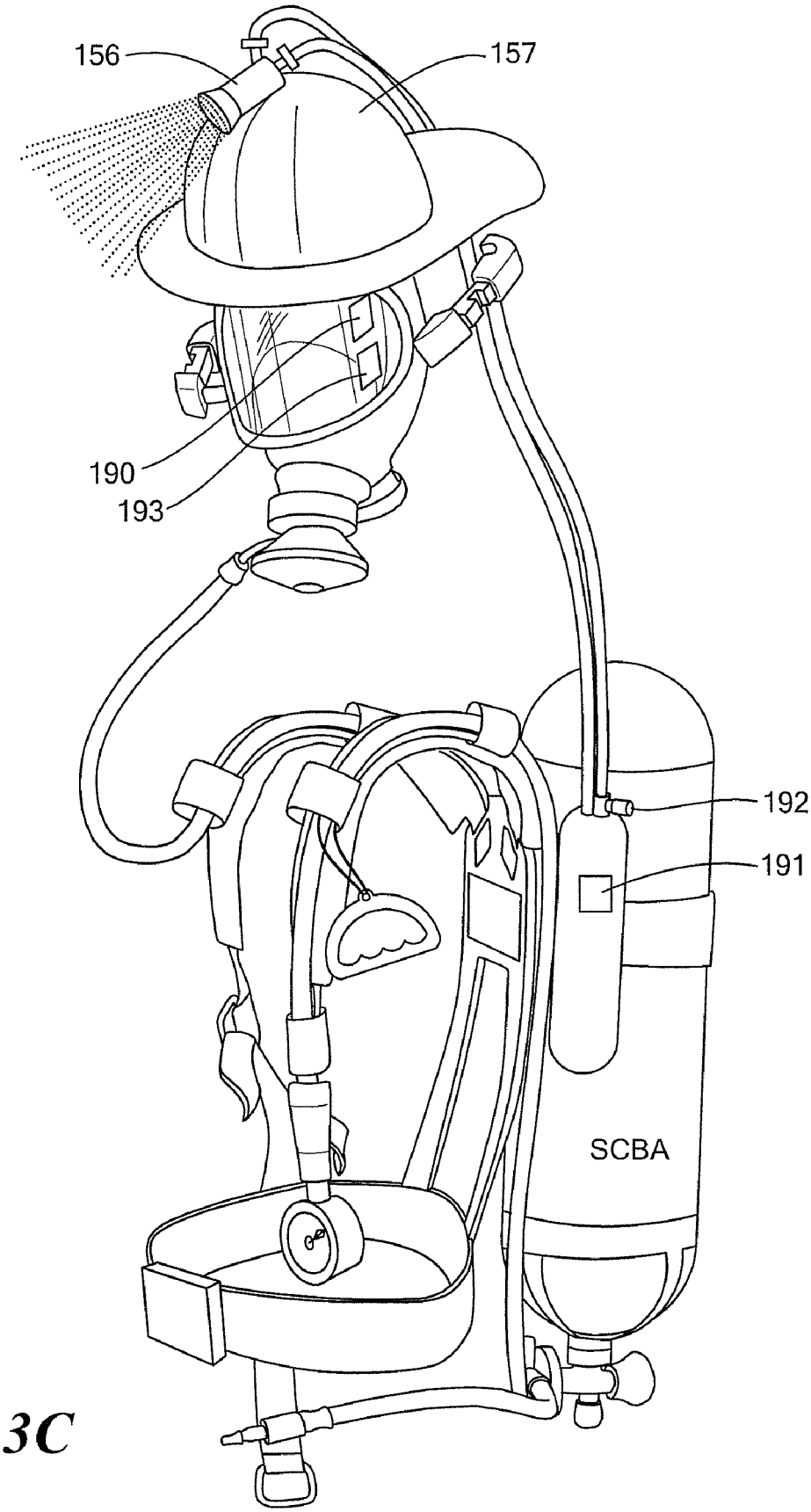
FIG. 3C is a schematic representation of another fire escape/egress system in accordance with exemplary embodiments of the invention.

In another embodiment shown in FIG. 3C, a system includes a first sensor 190 on a helmet 157 coupled to a controller 191 to control an activation mechanism 192 to generate mist from a nozzle 156. In one embodiment, the first sensor 190 detects one or more of predetermined levels of heat and smoke. If the threshold levels are exceeded, the controller 191 engages the activation mechanism 192 to generate mist.

In an alternative embodiment, the first sensor 190 monitors eye movement to detect a state of unconsciousness in the user in which case the controller 191 attempts to 'wake-up' the user by blowing a small mist charge from an auxiliary nozzle 193 inside the helmet 157 onto the face of the user. The controller 191 can wait a predetermined amount of time until blowing additional mist onto the face of the user. The controller can also selectively engage the activation mechanism 192 at intervals to create mist to suppress surrounding flame and thereby protect the user until help arrives.

Figure 5:
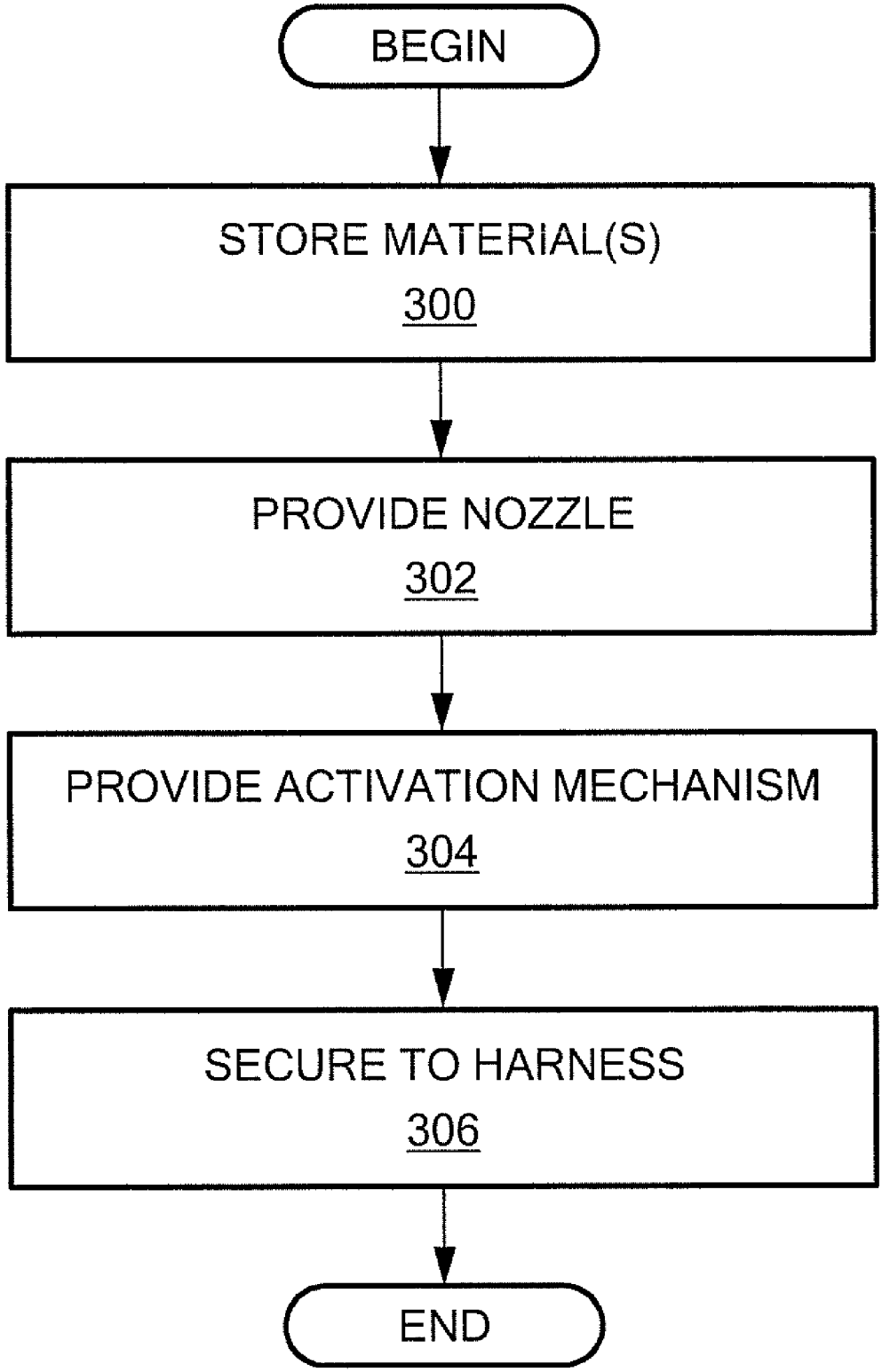
FIG. 5 is a flow diagram of an exemplary sequence of steps for providing fire escape/egress in accordance with exemplary embodiments of the invention.

FIG. 5 shows an exemplary sequence of steps for providing fire suppression in accordance with exemplary embodiments of the invention. In step 300, a first container for storing a first material, such as water, and a second container for storing a second pressurized material that is inert, such as CO2, nitrogen or helium, are coupled to a nozzle via a tube. In one embodiment, one end of the tube has a "Y" shape to provide respective branches for coupling to the first and second containers. In another embodiment the containers are integrated into a single apparatus without tubing. In step 302, the nozzle is provided as an atomizing nozzle to create a mist from the first and second materials that suppresses flame by evaporation, heat extraction, and oxygen displacement. In an exemplary embodiment, the nozzle is securable to a shoulder harness to direct the mist in front of a user and create an escape path. In another embodiment, there is a single nozzle mounted above the head (attached to helmet) which sprays a user selectable pattern from 30-360 degrees, in place of multiple nozzles, as in FIG. 3B.

In step 304, an activation mechanism is coupled to the first and second containers to enable release of the first and second materials when activated by the user. In one embodiment, the activation mechanism includes a pull cord to manipulate release valves on the first and second containers. In step 306, the containers and nozzle and are secured to a harness, such as a SCBA harness.

In one embodiment, water and CO2 are used to provide the mist at a ratio of 30:1 gas to water by volume. This ratio can vary from about 5:1 to about 50:1 gas to water by volume. It is understood that gases other than CO2 can be used instead of or in addition to CO2, such as nitrogen and compressed air. In other embodiments, extinguishments can be provided mixed or separately with the primary materials. Exemplary extinguishments include firefighting retardants, foaming agents, AFFF, etc.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A system, comprising:

a first container for storing a first fluid;

a second container for storing and providing a propellant;

a nozzle to mix and atomize material from the first and second containers for forming a mist to suppress a flame;

a propellant regulator coupled to the second container;

an activation mechanism to enable a user to release material in the first and second containers for generating the mist;

a sensor to monitor eye movement of the user and a controller coupled to the sensor to detect a state of unconsciousness; and an auxiliary nozzle coupled to the controller to spay mist onto a face of the user.

2. The system according to claim 1, further including a further regulator coupled to the first container to regulate the exit of the first fluid from the first container.

3. The system according to claim 1, wherein the nozzle is attachable to a harness.

4. The system according to claim 1, wherein the first fluid is water.

5. The system according to claim 1, wherein the first fluid is provided at a nozzle pressure ranging from about 10 PSI to about 50 PSI.

6. The system according to claim 1, wherein the propellant is provided at a pressure ranging from about 10 psi to about 65 psi.

7. The system according to claim 1, wherein the nozzle provides the mist having particles approximately 25-500 microns in size.

8. The system according to claim 1, wherein the second container is a tank for a self contained breathing apparatus (SCBA).

9. The system according to claim 1, wherein the second container is integrated with a self contained breathing apparatus (SCBA) tank.

10. The system according to claim 1, wherein the activation mechanism includes a pull cord.

11. The system according to claim 1, further including a sensor to detect heat and/or smoke for selectively engaging the activation mechanism and generating the mist.

12. The system according to claim 1, wherein the controller generates the mist at selected intervals for selected durations during a detected state of unconsciousness.

13. The system according to claim 1, wherein the activation mechanism, upon activation, triggers an audible and/or visual alarm.

14. The system according to claim 1, wherein the nozzle include dual inputs to mix materials from the first and second containers through a converge/diverge Venturi.

15. The system according to claim 1, further including a plurality of nozzles for directing the mist in directions different from the nozzle.

16. A system, comprising:

a harness;

an air tank for supplying air to a user;

a firefighter breathing apparatus coupled to the air tank to provide air to a user;

a first container for storing a first fluid, the first container secured to the air tank;

a second container for storing and providing a propellant;

a nozzle to atomize material from the first container for forming a mist to suppress a flame;

a first regulator coupled to the first container to regulate the exit of the first fluid from the first container;

a second regulator coupled to the second container;

an activation mechanism to enable a user to release material in the first and second containers for generating the mist;

a sensor to monitor eye movement of the user and a controller coupled to the sensor to detect a state of unconsciousness; and an auxiliary nozzle coupled to the controller to spay mist onto a face of the user.

17. The system according to claim 16, wherein the second container is the air tank so that air in the air tank pressurizes the fluid in the first container.

18. The system according to claim 16, wherein the first container is integrated with the air tank.

19. A method, comprising:

providing a first container to hold a first fluid;

providing a second container to hold a propellant providing a nozzle to atomize material from the first and second containers for forming a mist to suppress a flame;

coupling a first regulator coupled to the first container to regulate the exit of the first fluid from the first container;

coupling a second regulator to the second container;

providing an activation mechanism to enable a user to release material in the first and second containers for generating the mist providing a sensor to monitor eye movement of the user and a controller coupled to the sensor to detect a state of unconsciousness; and providing an auxiliary nozzle coupled to the controller to spay mist onto a face of the user.

20. The method according to claim 19, wherein the first fluid is provided at a pressure ranging from about 10 PSI to about 50 PSI.

* * * * *